United States Patent [19]

Zayat

[11] Patent Number: 4,813,464

[45] Date of Patent: Mar. 21, 1989

[54] ROTARY RESURFACING BLADE

[76] Inventor: Charles Zayat, 100 New Hampshire St., Cranston, R.I. 02920

[21] Appl. No.: 96,505

[22] Filed: Sep. 15, 1987

[51] Int. Cl.[4] ..... B27C 1/00

[52] U.S. Cl. ..... 144/118; 144/2 D; 144/115; 144/236

[58] Field of Search ..... 144/2 D, 38, 115, 118, 144/218, 231–240, 134 R

[56] References Cited

U.S. PATENT DOCUMENTS

| | | | |
|---|---|---|---|
| 380,203 | 3/1888 | Henderson | 144/118 |
| 397,568 | 2/1889 | Rudolph | 144/118 |
| 692,583 | 2/1902 | Zimmermann | 144/118 |
| 1,358,148 | 11/1920 | Gray | 144/115 |
| 3,812,891 | 5/1974 | Reuter | 144/118 |

*Primary Examiner*—W. Donald Bray
*Attorney, Agent, or Firm*—Joseph J. Zito

[57] ABSTRACT

A rotary blade for a resurfacing tool. The blade has two or more sets of teeth extending essentially perpendicular to the plane of the main disk of the blade. The teeth of varying rows are configured to perform either a rough first cut or a smooth finish cut or a cut inbetween. The blade is oriented in such a manner as to allow for a rough cut to a set depth followed by a smooth cut to a slightly greater depth.

4 Claims, 2 Drawing Sheets

ROTARY RESURFACING BLADE

BACKGROUND OF THE INVENTION

The present invention is generally related to devices for resurfacing the outer face of wood sided buildings. More specifically, the present invention is directed to the specific design of rotary blades for use in hand tools utilized for resurfacing of the exterior wood surface of a building.

U.S. Pat. No. 4,554,957, incorporated herein by reference, teaches a rotary resurfacing tool which utilizes a circular blade to refinish the face and overlying butt portion of shingle or clapboard siding.

SUMMARY OF THE INVENTION

It is an object of the present invention to provide a cutting disk configured to provide a first rough cut and a second finish cut of a surface for a resurfacing tool.

It is another object of the present invention to provide a rotary cutting blade for a resurfacing tool which allows for the quick removal of any surface coating through a first cut, and provides for a smooth final surface finish through a second cut.

It is yet another object of the present invention to provide a rotary cutting disk for a surface refinishing tool which provides faster, more accurate surface refinishing.

It is a further object of the present invention to provide a blade for surface finish removal and preparation for refinishing in a one-step process.

BRIEF DESCRIPTION OF THE DRAWINGS

A better understanding of the blade taught according to the present invention will be obtained through reference to the following detailed description, when taken in conjunction with the accompanying drawings, wherein like reference characters refer to like parts throughout these several views and in which.

DETAILED DESCRIPTION OF A PREFERRED EMBODIMENT

Figure 1:
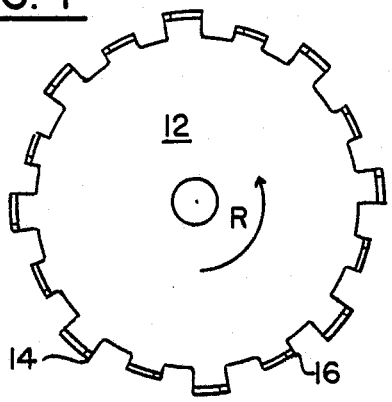
FIG. 1 is a plane view of the surface contacting side of the cutting disk.
Figure 2:
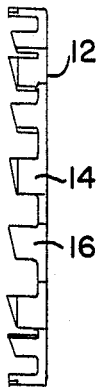
FIG. 2 is an edge view of the cutting disk.

Blade 10 as taught in the present invention and illustrated in FIG. 1, is comprised of a generally disk-shaped core 12, having two sets of cutting teeth 14 and 16 spaced about its periphery. Outer teeth 14 extend farther from the surface plane of core 12 than inner teeth 16, as better illustrated in FIG. 5. Outer teeth 14 also lie along a circle of greater radius than inner teeth 16.

Blade 10 is mounted in a rotary resurfacing tool 18, such as taught in U.S. Pat. No. 4,554,957, in FIG. 3. Resurfacing tool 18 includes a motor 20 which rotates blade 10 rapidly in the direction of arrow R, in FIGS. 1, 3, 4 and 6.

Figure 3:
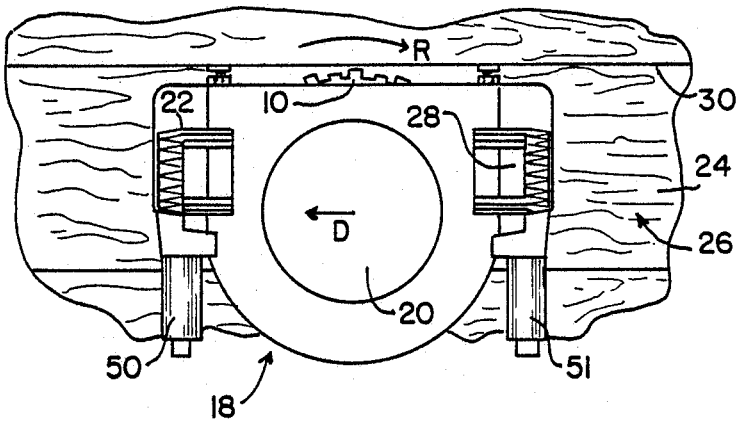
FIG. 3 illustrates a rotary resurfacing tool utilizing the blade of the present invention for surface refinishing.

Roller 50, FIG. 3, is adjusted by knob 22, such that roller 50 lifts the left side of tool 18 away from surface 24 of siding 26. Roller 51 is adjusted through knob 28 to position the right side of tool 18, to lie closer to surface 24 of siding 26. Teeth 14 and 16, therefore, contact surface 24 only during the right side portion of their rotation when they are in close enough proximity to surface 24, as illustrated in FIG. 4.

Figure 4:
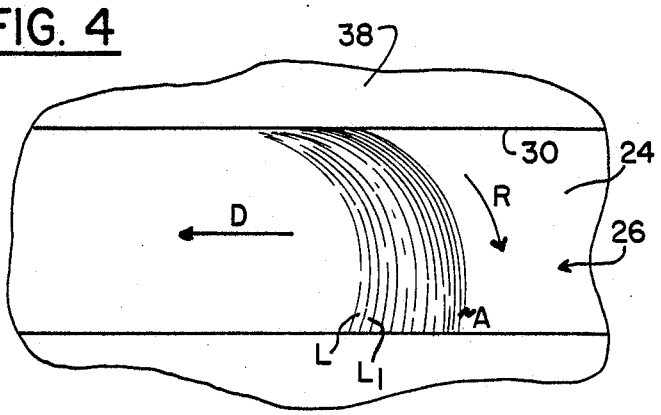
FIG. 4 illustrates the cuts produced by the cutting disk of the present invention when utilized with a rotary resurfacing tool.

Groove L, FIG. 4, illustrates the cut made by the circle of inner teeth 16 and groove $L_1$, and indicates the cut made by the set of outer teeth 14, as blade 10 is rotated. As tool 18 is moved towards the left as indicated by arrow D, the set of groove illustrated in FIG. 4 is formed from right to left, i.e. groove A through groove L. Teeth 16, because they do not project as far from the surface of cutting disk 10 as do teeth 14, will not cut as deeply into surface 24. Therefore, even after teeth 16 have passed over and cut surface 24, teeth 14 will still be able to cut the surface further. Teeth 16 are utilized to make the initial rough cut of the surface for removal of the worn prior finish of the surface. Teeth 14 then are utilized to make the finish cut to leave the proper smooth surface for future refinishing. Therefore, the cutting edge of teeth 14 and 16 are configured differently to allow for rough an smooth cutting, respectively.

Teeth 14 also contact the butt portion 30 of the siding piece 38 which overlies siding 26. Teeth 14, therefore, perform the dual purpose of resurfacing surface 24 and 30.

Figure 7A:
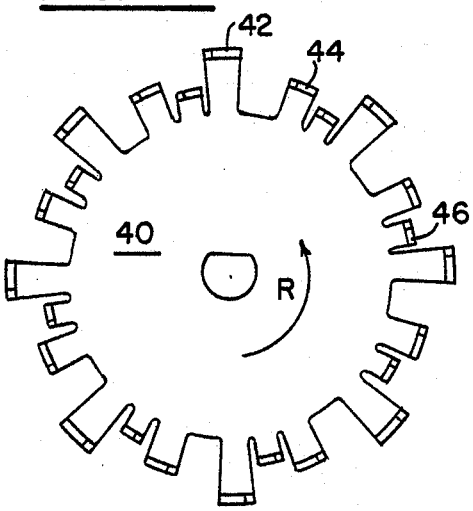
FIGS. 7A and 7B are bottom views of alternative disk configurations of the present invention, illustrating the cutting surfaces.
Figure 7B:
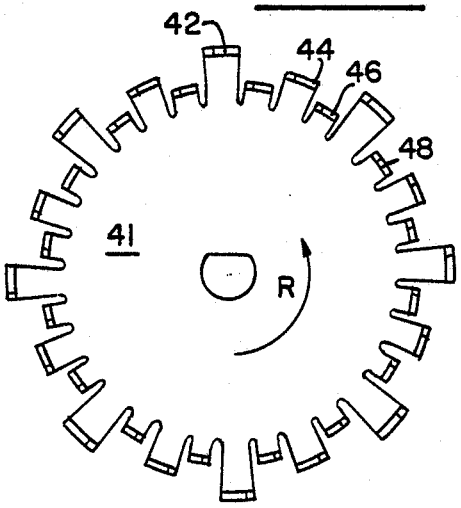

Alternative configurations for blades constructed in accordance with the teachings of the present invention are illustrated in FIGS. 7A and 7B. Blades 40 and 41 of FIGS. 7A and 7B have more than two rows of teeth: 42, 44, 46 and 48, positioned at different radiuses from the center of disk 40. In these embodiments, three or more separate cuts of the surface 24 are made. A first rough cut by teeth 42, intermediate cuts by teeth 44 and 46 and a final finish smooth cut by teeth 48.

A blade with any number of distinct rows of teeth can be utilized to accomplish the teachings of the present invention. The more successive cuts that are desired, to progress from the initial to the final cut, the more rows of teeth are required. Different resurfacing jobs may require different numbers of successive cuts in order to accomplish the final desired surface preparation. Such factors as the type and condition of prior surface finishes to be removed, and/or the material or condition of the underlying siding material may dictate the number of cuts, and therefore, the configuration of the blade to be utilized.

Figure 5:
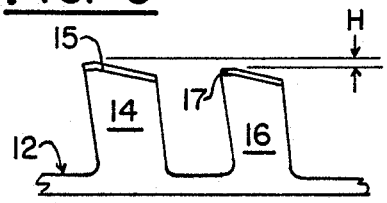
FIG. 5 is a side view of the teeth of the cutting disk of the present invention.
Figure 6:
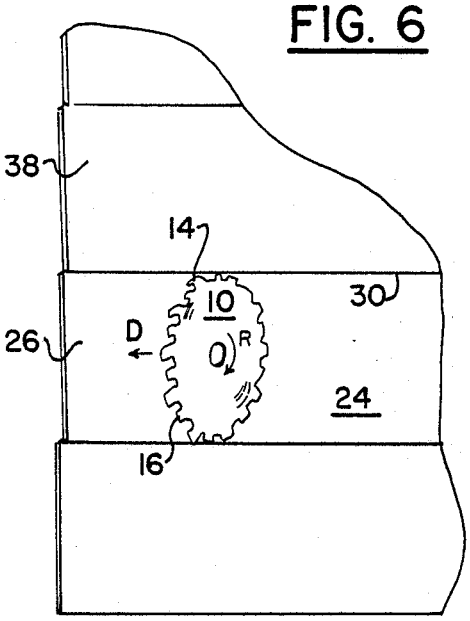
FIG. 6 is a perspective view illustrating the cutting disk of the present invention in contact with siding.

The blade itself can be manufactured utilizing any one of a number of standard manufacturing techniques accepted in the metal-working and saw blade manufacturing industry. For example, the blade could be initially cast as a flat disk, having a number of finger-like radial projections. These radial projections would then be bent perpendicular to the plane of the blade to form the teeth. The teeth could then be tipped, as illustrated in FIG. 5, with a carbide cutting surface 15 and 17. Tips 15 and 17 could also be formed from the steel utilized in initial fabrication of the blade itself. These would be considerations of manufacturing, based upon the desired final cutting properties of the blade. In another alternative example, the blade could be initially formed as a flat disk, having short finger-like projections. Cutting teeth could then be adhered perpendicular to the projections at the proper distance from the center of the blade by welding, braising or any other commonly accepted technique.

The difference in Height between the cutting surface of tip 15 and the cutting surface of tip 17, as illustrated in FIG. 5, is dependent upon the desired task to be performed by the blade 10. A greater or lesser difference in cutting depth will be determined again by the properties of the underlying siding surface 24 and the mechanical properties of the previous finish to be removed from surface 24. The difference in cutting depth of the two or three sets of teeth, as taught herein, can also be adjusted through the relative position of rollers 50 and 51. A greater tilt imparted to cutting tool 18 will create a larger depth-of-cut difference between teeth 14 and teeth 16.

Once given the above disclosure, many other features, modifications and improvements will become apparent to the skilled artisan. Such features, modifications and improvements are thus to be considered a part of this invention, the scope of which is to be determined by the following claims:

I claim:

1. A power tool blade for a tool for resurfacing an essentially planar surface, comprising:

a disk-shaped core having a center axis, a first set of cutting teeth lying along a first circle concentric with said center and spaced a first radial distance from said center, a second set of cutting teeth lying along a second circle concentric with said first circle and said blade disk center, positioned a second radial distance from said disk center, wherein said blade is rotated about said central axis by said tool while said tool maintains an orientation of said blade such that the plane of rotation of said blade is nonparallel to said surface whereby a first portion of said blade is closest to said surface when a second portion of said blade, lying 180 degrees about the circumference of said blade, is farthest from said surface, and said first set of teeth engage said surface to a first depth and said second set of teeth engage said surface to a depth greater than said first depth as said tool and said blade travel in a linear path essentially parallel to said surface.

2. The blade of claim 1, wherein;

said linear path of travel is defined by a diameter drawn from said first portion to said second portion, said second portion of said blade preceding said first portion in said travel, whereby said first set of teeth engage said surface prior to said second set.

3. The blade of claim 2, wherein;

said teeth have a component of projection perpendicular to said rotational plane toward said surface, said second radial distance is greater than said first radial distance, and said second set of teeth projects a greater distance perpendicularly from said surface of said disk than the perpendicular projection of said first set of teeth.

4. The blade of claim 1, further comprising:

a third set of teeth lying along a third circle, concentric with said first and second circles and with said center of said disk and spaced a third radial distance out from said center.

* * * * *